US010968021B2

(12) United States Patent
Kuwa et al.

(10) Patent No.: US 10,968,021 B2
(45) Date of Patent: Apr. 6, 2021

(54) BATTERY PACKAGING BODY

(71) Applicant: Maxell Holdings, Ltd., Kyoto (JP)

(72) Inventors: Tadahiro Kuwa, Kyoto (JP); Keiko Yamanaka, Kyoto (JP); Junichiro Miyazaki, Kyoto (JP); Akira Takagi, Kyoto (JP)

(73) Assignee: Maxell Holdings, Inc., Kyoto (JP)

( * ) Notice: Subject to any disclaimer, the term of this patent is extended or adjusted under 35 U.S.C. 154(b) by 0 days.

(21) Appl. No.: 16/481,572

(22) PCT Filed: May 11, 2018

(86) PCT No.: PCT/JP2018/018317
§ 371 (c)(1),
(2) Date: Jul. 29, 2019

(87) PCT Pub. No.: WO2018/207911
PCT Pub. Date: Nov. 15, 2018

(65) Prior Publication Data

US 2020/0108990 A1 Apr. 9, 2020

(30) Foreign Application Priority Data

May 11, 2017 (JP) ..... JP2017-095012
Aug. 14, 2017 (JP) ..... JP2017-156573

(51) Int. Cl.
*B65D 75/36* (2006.01)
*B65D 75/56* (2006.01)
*B65D 85/58* (2006.01)

(52) U.S. Cl.
CPC ..... *B65D 75/366* (2013.01); *B65D 75/367* (2013.01); *B65D 75/563* (2013.01); *B65D 85/58* (2013.01); *B65D 2585/88* (2013.01)

(58) Field of Classification Search
CPC .. B65D 75/366; B65D 75/367; B65D 75/563; B65D 85/58; B65D 2585/88
(Continued)

(56) References Cited

U.S. PATENT DOCUMENTS 5,203,455 A * 4/1993 Hewelt ..... B65D 75/367 206/460
5,775,505 A 7/1998 Vasquez et al.
(Continued)

FOREIGN PATENT DOCUMENTS

JP S60033068 U 3/1985
JP 2001106259 A 4/2001
(Continued)

OTHER PUBLICATIONS

International Search Report (PCT/ISA/210) dated Aug. 7, 2018, by the Japanese Patent Office as the International Searching Authority for International Application No. PCT/JP2018/018317.
(Continued)

*Primary Examiner* — Jacob K Ackun
(74) *Attorney, Agent, or Firm* — Buchanan Ingersoll & Rooney PC

(57) ABSTRACT

A battery packaging body allows, while infants can hardly take out a battery, a person other than infants can take out the battery. A battery packaging body includes a mount, and a blister cover which can accommodate a battery between the same and the mount. The mount and the blister cover are fixed to each other at least at their peripheral edge parts. The blister cover has a non-fixed part which is, at a position continuous to an accommodating projection, not fixed to the mount, and a first rib part provided along the accommodating projection. The non-fixed part is positioned on the opposite side to the first rib part across the accommodating projection and constitutes a part of a cuttable region P. The
(Continued)

first rib part extends in a direction crossing a direction in which the non-fixed part, the accommodating projection and the first rib part line up.

13 Claims, 8 Drawing Sheets

(58) Field of Classification Search
USPC ..... 206/703, 704, 705
See application file for complete search history.

(56) References Cited

U.S. PATENT DOCUMENTS

| | | | | |
|---|---|---|---|---|
| 6,029,818 | A * | 2/2000 | Kumakura ..... | B65D 75/366 206/469 |
| 2005/0051459 | A1 * | 3/2005 | Casanova ..... | B65D 75/366 206/703 |
| 2010/0122927 | A1 | 5/2010 | Matsuoka et al. | |

FOREIGN PATENT DOCUMENTS

| | | | |
|---|---|---|---|
| JP | 2001270556 | A | 10/2001 |
| JP | 2003142056 | A | 5/2003 |
| JP | 2004059124 | A | 2/2004 |
| JP | 2009241945 | A | 10/2009 |
| JP | 2010120657 | A | 6/2010 |
| JP | 2013116772 | A | 6/2013 |
| WO | 2017169812 | A1 | 10/2017 |

OTHER PUBLICATIONS

Written Opinion (PCT/ISA/237) dated Aug. 7, 2018, by the Japanese Patent Office as the International Searching Authority for International Application No. PCT/JP2018/018317.

Transmittal of International Preliminary Report on Patentability (Forms PCT/IB/326, PCT/IB/373 and PCT/ISA/237) dated Nov. 21, 2019, by the International Bureau of WIPO, in corresponding International Application No. PCT/JP2018/018317. (6 pages).

Notification of Transmittal of Translation of the International Preliminary Report on Patentability (Forms PCT/IB/338, PCT/IB/373 and PCT/ISA/237) dated Nov. 21, 2019, by the International Bureau of WIPO, in corresponding International Application No. PCT/JP2018/018317. (7 pages).

* cited by examiner

BATTERY PACKAGING BODY

TECHNICAL FIELD

The present invention relates to a battery packaging body for packaging a battery.

BACKGROUND ART

There is known a battery packaging body for packaging a battery. As such a battery packaging body, for example, Patent Literature 1 discloses a blister package composed of a mount and a blister cover having an accommodating part and fixed to the mount. With such a blister package, a battery is accommodated in an accommodating space formed of the accommodating part between the mount and the blister cover.

In general, perforations or the like are provided on the blister package having the aforementioned configuration at a position, on the mount, corresponding to the accommodating part. Thus, when the battery accommodated in the accommodating space is taken out from the blister package, there are employed methods of taking out the battery by breaking the mount along the perforations thereon, and taking out the battery while allowing the battery to break through the mount by pushing the battery via the blister cover to the mount side. On the other hand, when perforations as above are not provided on the mount, the battery is taken out by peeling off the mount and the blister cover from each other.

A battery packaging body having the configuration as above employs a configuration by which a battery can be easily taken out. This causes a possibility that infants easily take out the battery from the battery packaging body to mistakenly swallow the battery.

On the contrary, by using a blister container, for example, disclosed in Patent Literature 2 as a battery packaging body, it is considered that infants cannot easily open it. In this blister container disclosed in Patent Literature 2, a cutting scheduled part obtained by forming a part of the blister cover to be shallow is provided therein. With use of an opening part appearing by cutting the cutting scheduled part along with the mount with scissors or the like, the blister cover and the mount are peeled off from each other, and thereby, a person other than infants can take out a solid article inside while it is difficult for infants to open them.

CITATION LIST

Patent Literature

Patent Literature 1: Japanese Patent Laid-Open No. 2004-59124

Patent Literature 2: Japanese Patent Laid-Open No. 2009-241945

SUMMARY OF INVENTION

Technical Problem

Now, in the aforementioned configuration disclosed in Patent Literature 2, the cutting scheduled part is provided in the blister cover by forming a part thereof to be shallow. Therefore, the ratio of a portion in which the blister cover is three-dimensionally formed (three-dimensional portion) out of the blister container is large.

Moreover, the aforementioned blister container disclosed in Patent Literature 2 has, in the first place, the configuration for taking out a battery by peeling off the blister cover and the mount from each other. Therefore, the adhesion between the blister cover and the mount is not very strong.

There is therefore a possibility that when an infant bends or twists the blister container, the three-dimensional portion of the blister cover suffers large force to break or to cause the blister cover and the mount to be peeled off from each other, and that the infant takes out the battery.

Therefore, even when the aforementioned blister container disclosed in Patent Literature 2 is applied to a battery packaging body, there is a possibility that an infant breaks the battery packaging body and takes out a battery inside to mistakenly swallow it. Meanwhile, a battery packaging body of course needs to have a configuration with which a person other than infants can take out a battery from the battery packaging body when the person is to use the battery.

An object of the present invention is to obtain a configuration of a battery packaging body, for packaging a battery, which allows while infants can hardly take out the battery, a person other than infants can take out the battery.

Solution to Problem

A battery packaging body according to an embodiment of the present invention is a battery packaging body for packaging a battery. This battery packaging body includes: a first member; and a second member capable of accommodating the battery between the same and the first member. The first member and the second member are fixed to each other at least at their peripheral edge parts. The second member has: an accommodating projection protruding in a thickness direction of the second member so as to form an accommodating space capable of accommodating the battery between the same and the first member; a non-fixed part provided at a position continuous to the accommodating projection and not fixed to the first member; and a first rib part provided along the accommodating projection and protruding in the thickness direction of the second member. The non-fixed part is positioned on an opposite side to the first rib part across the accommodating projection and constitutes a part of a cuttable region cut when the battery packaging body is opened. The first rib part extends in a direction crossing a direction in which the non-fixed part, the accommodating projection and the first rib part line up (first configuration).

In the battery packaging body having the aforementioned configuration, the first member and the second member are fixed to each other at least at their peripheral edge parts, and thereby, an opening portion for opening the battery packaging body does not exist before the cuttable region is cut. Therefore, infants cannot easily take out the battery from the battery packaging body.

By cutting the battery packaging body at the cuttable region including the non-fixed part continuous to the accommodating projection, an opening can be provided between the first member and the second member on its cut end face. Since the non-fixed part is positioned on the opposite side to the first rib part across the accommodating projection, a portion in which the opening is provided in cutting at the cuttable region is at a position on the opposite side to the first rib part across the accommodating projection.

In the aforementioned configuration, the first rib part extends in the direction crossing the direction in which the non-fixed part, the accommodating projection and the first rib part line up. Therefore, in the battery packaging body after cutting, when both end parts of the battery packaging body positioned on an extended line of the first rib part in its direction of extension are folded to the first member side in the thickness direction to press the same such that the both end parts come close to each other, while the first rib part receives compressive force in the crossing direction, the first member and the second member largely separate from each other on the cut end faces to widely expand the opening. Thereby, the battery can be easily taken out from the accommodating space formed of the accommodating projection.

In the first configuration, the cuttable region linearly extends in the crossing direction (second configuration). Thereby, when the battery is taken out from the battery packaging body, the battery packaging body can be easily cut at the cuttable region.

In the first or second configuration, the first rib part has a length greater than a dimension of the battery in the crossing direction (third configuration). Thereby, in the battery packaging body cut at the cuttable region, by folding both end parts above in the direction crossing the direction in which the non-fixed part, the accommodating projection and the first rib part line up to the first member side in the thickness direction to press the same such that the both end parts come close to each other, the first member and the second member can more largely separate from each other on the cut end faces to more widely expand the opening on the cut end faces. Therefore, the battery can be more easily taken out from the accommodating space formed of the accommodating projection.

In any one configuration of the first to third configurations, the second member has a second rib part extending along the accommodating projection in the direction in which the non-fixed part, the accommodating projection and the first rib part line up (fourth configuration).

Thereby, in the battery packaging body, the rigidity in the direction in which the non-fixed part, the accommodating projection and the first rib part line up can be improved. In addition to this, in the battery packaging body cut at the cuttable region, by folding both end parts above in the direction crossing the direction in which the non-fixed part, the accommodating projection and the first rib part line up to the first member side in the thickness direction to press the same such that the both end parts come close to each other, the first member and the second member can more easily separate from each other on the cut end faces to more easily expand the opening on the cut end faces.

In the fourth configuration, the second rib part is connected to the first rib part (fifth configuration). Thereby, the rigidity of the battery packaging body can be improved. In addition to this, in the battery packaging body cut at the cuttable region, by folding both end parts above in the direction crossing the direction in which the non-fixed part, the accommodating projection and the first rib part line up to the first member side in the thickness direction to press the same such that the both end parts come close to each other, the first member and the second member can more easily separate from each other on the cut end faces to more easily expand the opening on the cut end faces.

In the fifth configuration, the first rib part and the second rib part are formed to be U-shaped as a whole as seen in the thickness direction of the second member (sixth configuration). Thereby, the rigidity of the battery packaging body can be more improved. In addition to this, in the battery packaging body cut at the cuttable region, by folding both end parts above in the direction crossing the direction in which the non-fixed part, the accommodating projection and the first rib part line up to the first member side in the thickness direction to press the same such that the both end parts come close to each other, the first member and the second member can more easily separate from each other on the cut end faces to more easily expand the opening on the cut end faces.

In any one configuration of the fourth to sixth configurations, in the cuttable region, at least a center portion of the second member in the crossing direction as seen in the thickness direction of second member is flat plate-shaped to be parallel to the first member in the thickness direction (seventh configuration).

Thereby, in the cuttable region, there are no convexities or concavities in at least the center portion of the second member in the crossing direction, and hence, the second member can be easily cut at the cuttable region. Notably, to be parallel means that the second member is disposed along the first member and the distance between the first member and the second member is uniform within the cuttable region.

In a configuration described in any one of the fourth to seventh configurations, in the cuttable region, the second member is flat plate-shaped to be parallel to the first member in the thickness direction. In the non-fixed part, the cuttable region does not overlap with the second rib part as seen in the thickness direction of the second member (eighth configuration).

Thereby, there are no convexities or concavities in the cuttable region, and hence, the second member can be more easily cut at the cuttable region.

In any one configuration of the first to eighth configurations, the first rib part is connected to the accommodating projection (ninth configuration). Thereby, the accommodating projection and the first rib part can be disposed closer to each other. Therefore, the battery packaging body can be made compact.

In any one configuration of the first to ninth configurations, the rigidity of the first member is lower than the rigidity of the second member in the direction crossing the direction in which the non-fixed part, the accommodating projection and the first rib part line up (tenth configuration).

Thereby, in the battery packaging body cut at the cuttable region, by folding both end parts above in the direction crossing the direction in which the non-fixed part, the accommodating projection and the first rib part line up to the first member side in the thickness direction to press the same such that the both end parts come close to each other, the first member can be easily deformed relative to the second member on the cut end face. Therefore, in the battery packaging body, by folding both end parts above in the crossing direction to the first member side in the thickness direction to press the same such that the both end parts come close to each other, the first member and the second member can more easily separate from each other on the cut end faces to more widely expand the opening on the cut end faces.

In the battery packaging body described in any one of the first to tenth configurations, the rigidity of the first rib part is higher than the rigidity of a portion positioned in the crossing direction relative to the first rib part out of a portion in which the first member and the second member are fixed to each other (eleventh configuration).

Thereby, in the battery packaging body cut at the cuttable region, by folding both end parts above in the direction crossing the direction in which the non-fixed part, the accommodating projection and the first rib part line up to the first member side in the thickness direction to press the same such that the both end parts come close to each other, the first member can be easily deformed relative to the second member on the cut end face. Therefore, in the battery packaging body, by folding both end parts above in the crossing direction to the first member side in the thickness direction to press the same such that the both end parts come close to each other, the first member and the second member can more easily separate from each other on the cut end faces to more easily expand the opening on the cut end faces.

In any one configuration of the first to eleventh configurations, a thickness of the first member is smaller than a thickness of the second member (twelfth configuration).

Thereby, in the battery packaging body cut at the cuttable region, by folding both end parts above in the direction crossing the direction in which the non-fixed part, the accommodating projection and the first rib part line up to the first member side in the thickness direction to press the same such that the both end parts come close to each other, the first member can be easily deformed relative to the second member on the cut end face. Thereby, in the battery packaging body, by folding both end parts above in the crossing direction to the first member side in the thickness direction to press the same such that the both end parts come close to each other, the first member and the second member can more easily separate from each other in the cut end faces to more easily expand the opening on the cut end faces.

In any one configuration of the first to twelfth configurations, the first member is configured to bend in the thickness direction and to separate from the second member in its region corresponding to the accommodating projection in the crossing direction on the cut end face formed by cutting at the cuttable region as seen in the direction in which the non-fixed part, the accommodating projection and the first rib part line up, when both end parts of the first member and the second member in the crossing direction are bent to the first member side in the thickness direction by exerting compressive force on the first member and the second member cut at the cuttable region in the direction crossing the direction in which the non-fixed part, the accommodating projection and the first rib part line up (thirteenth configuration).

Thereby, in the battery packaging body cut at the cuttable region, the opening on the cut end faces can be more widely expanded. Therefore, the battery can be more easily taken out from the accommodating space formed of the accommodating projection.

Advantageous Effects of Invention

In the battery packaging body according to an embodiment of the present invention, the second member fixed to the first member at least at its peripheral edge part has the non-fixed part provided at the position continuous to the accommodating projection and not fixed to the first member, and the first rib part provided along the accommodating projection. The non-fixed part is positioned on the opposite side to the first rib part across the accommodating projection and constitutes a part of the cuttable region. The first rib part extends in the direction crossing the direction in which the non-fixed part, the accommodating projection and the first rib part line up.

Thereby, there can be obtained a configuration of a battery packaging body which allows, while infants can hardly take out a battery, a person other than infants can take out the battery.

DESCRIPTION OF EMBODIMENTS

Figure 1:
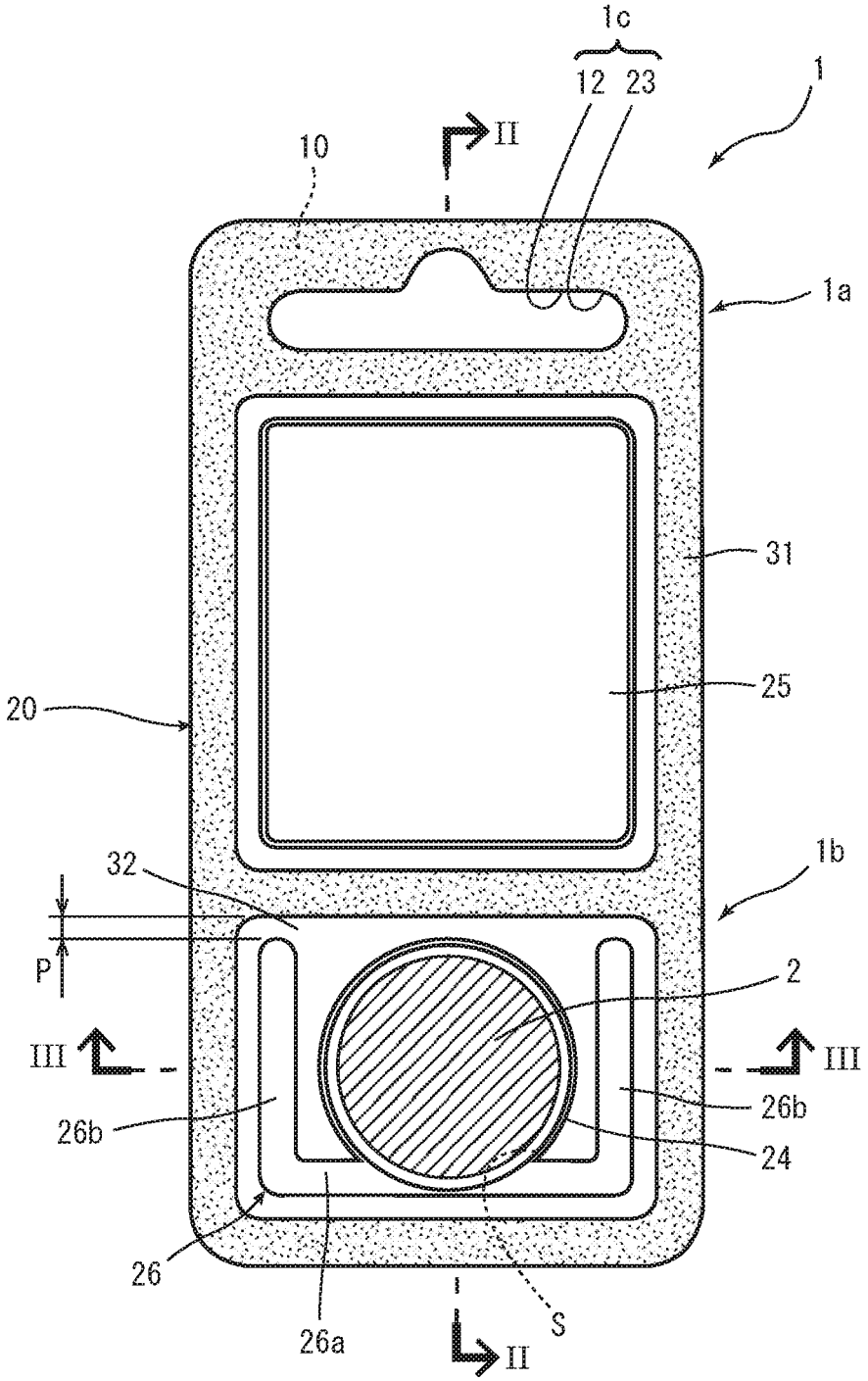
FIG. 1 is an elevational view showing a schematic configuration of a battery packaging body according to Embodiment 1.

Hereafter, embodiments of the present invention are described in detail with reference to the drawings. The same or corresponding portions in the drawings are given the same signs, and their descriptions are not repeated.

Embodiment 1

Figure 2:
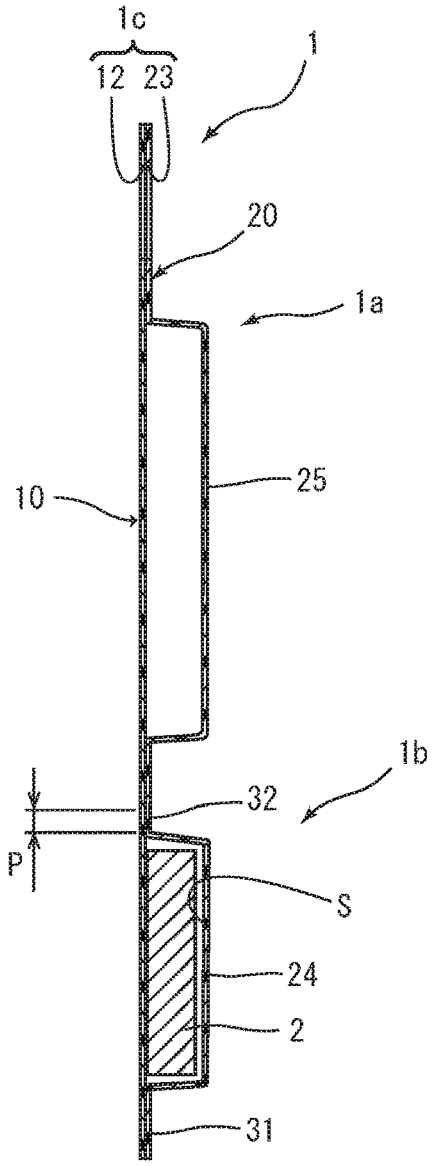
FIG. 2 is a cross-sectional view taken along the II-II line in FIG. 1.
Figure 3:
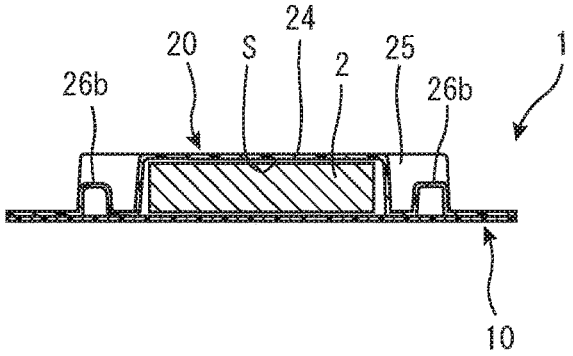
FIG. 3 is a cross-sectional view taken along the line in FIG. 1.

FIG. 1 is a diagram showing a schematic configuration of a battery packaging body 1 according to Embodiment 1 of the present invention. FIG. 2 is a cross-sectional view taken along the II-II line in FIG. 1. FIG. 3 is a cross-sectional view taken along the line in FIG. 1. The battery packaging body 1 is a packaging body, for example, for packaging a coin-type battery and a button-type battery. The battery packaging body 1 has a mount 10 (first member) and a blister cover 20 (second member). Namely, in the battery packaging body 1 of the present embodiment, the mount 10 and the blister cover 20 are fixed to each other.

The battery packaging body 1 has a held part 1*a* which is hung on a hook or the like of a showcase in a shop, and a battery accommodating part 1*b* which accommodates a battery 2. The held part 1*a* and the battery accommodating part 1*b* are arranged to line up in one direction. Namely, the battery packaging body 1 has a rectangular shape long in the one direction. Notably, the held part 1*a* and the battery accommodating part 1*b* are constituted by combining each part of the mount and the blister cover 20.

The mount 10 is made of resin, for example, containing PE (polyethylene) and PET (polyethylene telephthalate). In the present embodiment, the mount 10 is constituted by stacking each sheet of PET, PET vapor-deposited with Al, and PE in the thickness direction. Namely, the mount 10 is constituted of a material in which PET vapor-deposited with Al is disposed between PET and PE. Moreover, the blister cover 20 is fixed on a surface, of the mount 10, that is on the PE side. In the present embodiment, the mount 10 is formed to be rectangular plate-shaped.

Notably, the mount 10 may contain another resin (PS (polystyrene), PVC (polyvinyl chloride) or the like), or may be composed of any material as long as it is a material which functions as a mount. Moreover, the mount 10 may have convexities and concavities.

The thickness of the mount 10 is smaller than the thickness of the blister cover 20. Moreover, the rigidity of the mount 10 in the transverse direction (direction crossing a direction in which a non-fixed part 32, an accommodating projection 24 and a first rib part 26*a* mentioned later line up) is lower than the rigidity of the blister cover 20 in the transverse direction.

A through hole 12 for hanging the battery packaging body 1 on a hook or the like of a showcase in a store is formed on one side of the mount 10 in the longitudinal direction. The one side of the mount 10 in the longitudinal direction constitutes a part of the held part 1*a* of the battery packaging body 1.

The blister cover 20 is made of resin, for example, containing PE and PET. The blister cover 20 is formed to be rectangular in plan view so as to correspond to the mount 10. When the blister cover 20 has a configuration in which PE and PET are stacked in the thickness direction, the mount 10 is fixed onto its surface on the PE side.

Notably, the blister cover 20 may be constituted of a laminate film, or the like composed, for example, of PS, PVC and another material as long as it is made of transparent resin.

As shown in FIG. 1 and FIG. 2, a through hole 23 constituting a through hole 1*c* of the battery packaging body 1 along with the through hole 12 provided in the mount 10 is formed on one side of the blister cover 20 in the longitudinal direction. Namely, the one side of the blister cover 20 in the longitudinal direction constitutes the held part 1*a* of the battery packaging body 1 along with the one side of the mount 10 in the longitudinal direction.

The blister cover 20 has an accommodating projection 24 which forms an accommodating space S for accommodating the battery 2 between the same and the mount 10, on the other side in the longitudinal direction in the state of being combined with the mount 10. Namely, as shown in FIG. 2, the blister cover 20 has a shape in which its part in the longitudinal direction protrudes in the thickness direction in lateral view. The accommodating projection 24 has a dimension with which the battery 2 can be accommodated. The blister cover 20 is formed to have a flat plane shape in which portions other than the accommodating projection 24 and a projection 25 and a rib part 26 which are mentioned later are in contact with the mount 10 in the state of being combined with the mount 10.

As shown in FIG. 1 to FIG. 3, the blister cover 20 has: a projection 25 which protrudes in the thickness direction and is rectangular in plan view in the held part 1*a*; and a rib part 26 which protrudes in the thickness direction so as to enclose the accommodating projection 24.

The rib part 26 has: a first rib part 26*a* provided on the other side of the blister cover 20 in the longitudinal direction relative to the accommodating projection 24; and a pair of second rib parts 26*b* provided on both sides of the blister cover 20 in the transverse direction.

The first rib part 26*a* is provided so as to protrude in the thickness direction of the blister cover 20 on the opposite side to the held part 1*a* across the accommodating projection 24 in the longitudinal direction of the blister cover 20. The first rib part 26*a* is provided so as to linearly extend in the transverse direction of the blister cover 20. Namely, the first rib part 26*a* extends in a direction crossing the direction in which the non-fixed part 32 mentioned later, the accommodating projection 24 and the first rib part 26*a* line up (the longitudinal direction of the blister cover 20). Notably, the height of protrusion of the first rib part 26*a* is smaller than the height of protrusion of the accommodating projection 24.

The length of the first rib part 26*a* in the direction of extension thereof (the crossing direction) is greater than the diameter of the battery 2 accommodated in the accommodating space S (dimension thereof in the crossing direction). Namely, the first rib part 26*a* protrudes outward of the battery 2 in the transverse direction of the blister cover 20 in plan view of the battery packaging body 1.

The rigidity of the first rib part 26*a* is higher than the rigidity of portions positioned in the direction of extension (the crossing direction) relative to the first rib part 26*a* out of the portion in which the mount 10 and the blister cover 20 are fixed to each other.

The center portion of the first rib part 26*a* in the direction of extension is connected to the accommodating projection 24. Namely, parts of the first rib part 26*a* and the accommodating projection 24 are integrated. Thereby, the battery packaging body 1 can be made compact in the longitudinal direction of the battery packaging body 1. Notably, the first rib part 26*a* and the accommodating projection 24 may be separate.

The pair of second rib parts 26*b* are provided to protrude in the thickness direction of the blister cover 20 on both sides sandwiching the accommodating projection 24 in the transverse direction of the blister cover 20. Each second rib part 26*b* is provided to linearly extend in the longitudinal direction of the blister cover 20 (direction in which the non-fixed part 32, the accommodating projection 24 and the first rib part 26*a* line up). In the present embodiment, the pair of second rib parts 26*b* extend in the direction perpendicular to the first rib part 26*a*. Notably, while in the present embodiment, the pair of second rib parts 26*b* are perpendicular to the first rib part 26*a*, not limited to this mode, they only have to cross the first rib part 26*a*.

The heights of protrusion of the second rib parts 26*b* are smaller than the height of protrusion of the accommodating projection 24. Moreover, the length of each second rib part 26*b* in the direction of extension thereof is greater than the diameter of the battery 2 accommodated in the accommodating space S (dimension thereof in the direction of extension). Notably, the length of each second rib part 26*b* in the direction of extension thereof may be smaller than the diameter of the battery 2.

The first rib part 26*a* and the pair of second rib parts 26*b* are integrated. Namely, one side of each of the pair of second rib parts 26*b* in the longitudinal direction of the blister cover 20 is connected to corresponding one of both end parts of the first rib part 26*a* in the transverse direction of the blister cover 20. Thereby, the rib part 26 is formed into a substantial U-shape in plan view so as to enclose the accommodating projection 24. Notably, the substantial U-shape includes a shape having corners as well as one having a U-shaped curve.

In the present embodiment, each of the first rib part 26*a* and the pair of second rib parts 26*b* has a substantially semicircular cross section as a cross section perpendicular to its direction of extension. Notably, each of the first rib part 26*a* and the pair of second rib parts 26*b* may have any cross section other than the substantial semicircle as the aforementioned cross section.

As mentioned above, the projection 25 and the rib part 26 are provided on the blister cover 20, and thereby, the rigidity of the battery packaging body 1 can be secured. In addition to this, providing the rib part 26 can enhance the rigidity of the periphery of the accommodating projection 24 in the battery packaging body 1. Hence, the accommodating space S in which the battery 2 is accommodated can be suppressed from collapsing.

Furthermore, providing the rib part 26 allows the mount 10 and the blister cover 20 to be easily deformed, as mentioned later, when the non-fixed part 32 of the mount 10 and the blister cover 20 is cut and the battery 2 is taken out from the accommodating space S. Accordingly, the battery 2 can be easily taken out from the accommodating space S of the battery packaging body 1.

The mount 10 and the blister cover 20 are fixed to each other at a portion other than the accommodating projection 24, the projection 25 and the rib part 26 with an adhesive agent (for example, mixed resin of polyester resin and epoxy resin, acrylic resin, copolymer resin of vinyl chloride and vinyl acetate, or the like), by heat sealing, or the like. Namely, the mount 10 and the blister cover 20 are fixed to each other at least at their peripheral edge parts. Moreover, the mount 10 and the blister cover 20 are fixed to each other also between the projection 25 and the accommodating projection 24 and the rib part 26 in the longitudinal direction of the battery packaging body 1. FIG. 1 shows a fixed part 31 in which the mount 10 and the blister cover 20 are fixed to each other as the dotted area.

As above, the mount 10 and the blister cover 20 are fixed to each other at their peripheral edge parts, and thereby, infants can be prevented from easily opening the battery packaging body 1.

The battery packaging body 1 has the non-fixed part 32 at which the mount and the blister cover 20 are not bonded or fixed to each other on one side of the accommodating projection 24 and the rib part 26 in the longitudinal direction, that is, on the opposite side to the first rib part 26*a* across the accommodating projection 24. The non-fixed part 32 is positioned between the projection 25 and the accommodating projection 24 and the rib part 26, and is continuous to the accommodating projection 24 and the rib part 26. Namely, a fixed part does not exist between the non-fixed part 32 and the accommodating projection 24 and the rib part 26.

The non-fixed part 32 is provided to linearly extend in the transverse direction of the battery packaging body 1 (direction crossing the direction in which the non-fixed part 32, the accommodating projection 24 and the first rib part 26*a* line up) on the opposite side to the first rib part 26*a* across the accommodating projection 24 in the longitudinal direction of the battery packaging body 1. The non-fixed part 32 constitutes a part of a cuttable region P which is cut with scissors or the like when the battery packaging body 1 is opened as mentioned later. Namely, the battery packaging body 1 is to be cut in the transverse direction so as also to cut the non-fixed part 32, and thereby, an opening 33 is formed in the non-fixed part 32. Hence, the battery 2 in the accommodating space S can be taken out through the opening 33.

Notably, in the present embodiment, the battery packaging body 1 has non-fixed parts also around the projection 25 and the rib part 26 (see white areas in FIG. 1). Nevertheless, the battery packaging body 1 does not need to have such non-fixed parts other than the aforementioned non-fixed part 32.

The cuttable region P is constituted of a part of the non-fixed part 32. In the present embodiment, the cuttable region P linearly extends in the transverse direction of the battery packaging body 1 (direction crossing the direction in which the non-fixed part 32, the accommodating projection 24 and the first rib part 26*a* line up). Notably, the cuttable region may have an arc shape or the like as well as a linear shape.

In the cuttable region P, at least a center portion of the blister cover 20 in the transverse direction as seen in the thickness direction is flat plate-shaped to be parallel to the mount 10 in the thickness direction. Namely, in at least the center portion of the cuttable region P in the transverse direction, convexities and concavities are not formed on the blister cover 20. In the present embodiment, in the cuttable region P, the blister cover 20 is flat plate-shaped to be parallel to the mount 10 in the thickness direction. Moreover, in the non-fixed part 32, the cuttable region P is positioned in the direction in which the non-fixed part, the accommodating projection and the first rib part line up relative to the second rib parts 26*b*. Namely, in the non-fixed part 32, the cuttable region P does not overlap with the second rib parts 26*b* of the blister cover 20 as seen in the thickness direction of the blister cover 20. Thereby, the battery packaging body 1 can be easily cut at the cuttable region P.

Notably, to be parallel means that the blister cover 20 is disposed along the mount 10 and the distance between the mount 10 and the blister cover 20 is uniform.

(Taking-Out of Battery from Battery Packaging Body)

Next, opening the battery packaging body 1 having the aforementioned configurations is described.

Figure 4:
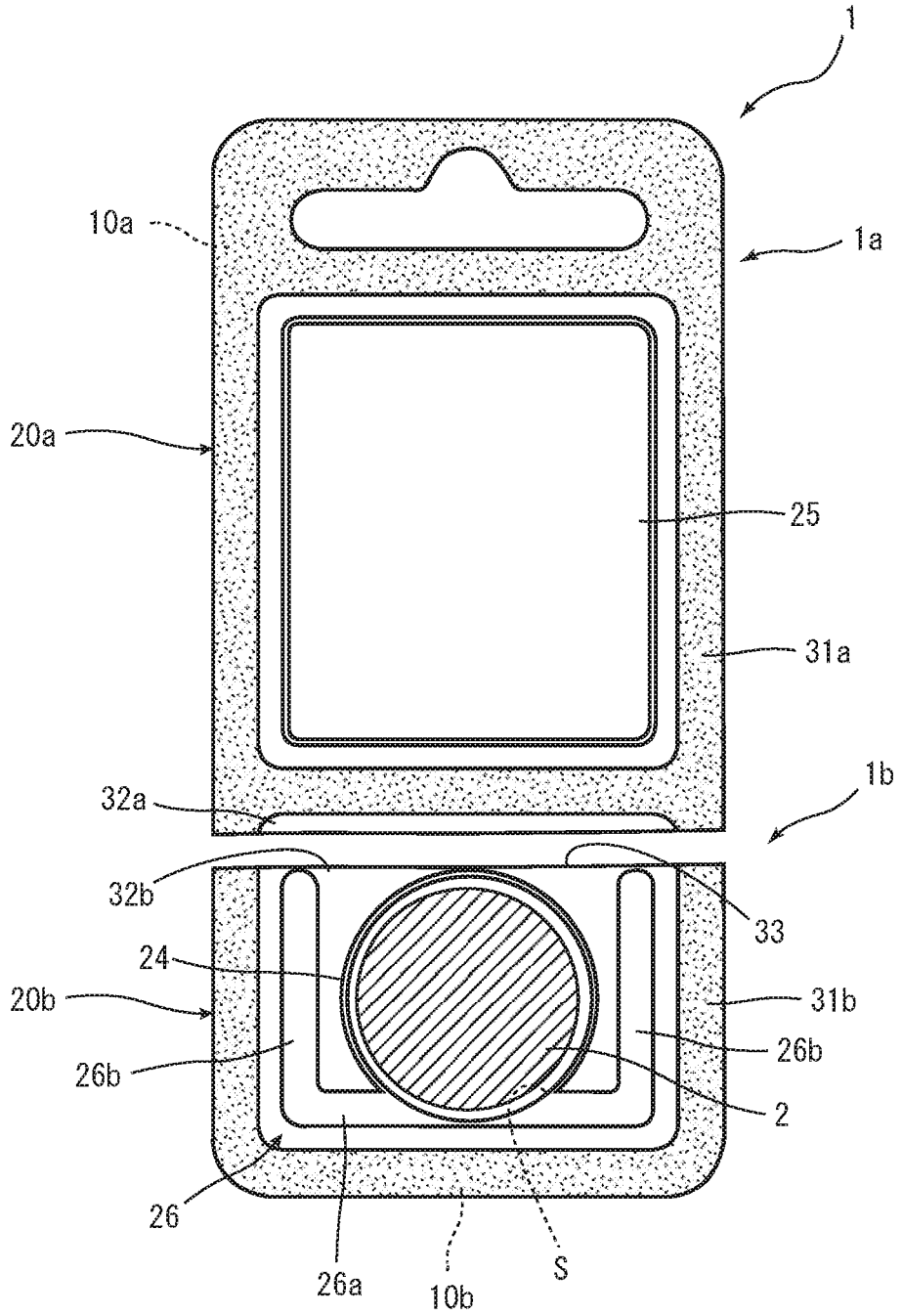
FIG. 4 is a view showing a state where the battery packaging body is cut at a cuttable region.

As shown in FIG. 4, when the cuttable region P of the battery packaging body 1 is cut with scissors or the like, the battery packaging body 1 is separated into the held part 1*a* and the battery accommodating part 1*b*. Thereby, the held part 1*a* which is not needed when the battery packaging body 1 is opened can be removed.

Moreover, by cutting the cuttable region P of the battery packaging body 1 with scissors or the like as above, the battery packaging body 1 is cut through the non-fixed part 32.

In the following description, pieces of the blister cover after cut at the cuttable region P are individually referred to as blister covers 20*a* and 20*b*, and pieces of the mount after cut at the cuttable region P are individually referred to as mounts 10*a* and 10*b*. Moreover, pieces of the non-fixed part after cutting are individually referred to as non-fixed parts 32*a* and 32*b*, and pieces of the fixed part after cutting are individually referred to as fixed parts 31*a* and 31*b*. Cut end faces formed on the blister cover 20*b* and the mount 10*b* in cutting at the cuttable region P are designated as X.

By cutting the cuttable region P of the battery packaging body 1 with scissors or the like as above, the non-fixed part 32 is segmented into the non-fixed parts 32*a* and 32*b*. Thereby, the opening 33 is formed on the cut end faces X of the non-fixed part 32*b*. The non-fixed part 32*b* is continuous to the accommodating projection 24. Therefore, formation of the opening 33 in the non-fixed part 32*b* allows the accommodating space S formed of the accommodating projection 24 to be continuous to the outside through the opening 33. Nevertheless, since the non-fixed part 32*b* is formed to be a flat plane shape along the mount 10*b*, the opening area of the opening 33 is small. Therefore, in order to take out the battery 2 to the outside, the opening area of the opening 33 needs to be expanded to the dimension with which the battery 2 can pass through.

Figure 5:
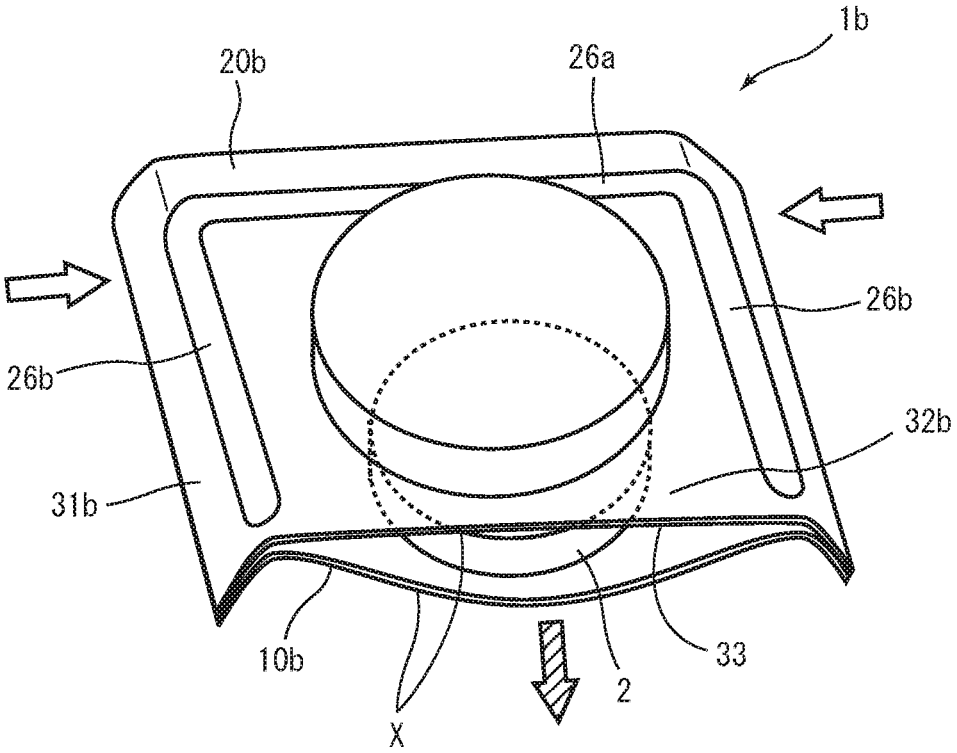
FIG. 5 is a view schematically showing a battery taken out from the cut battery packaging body.

To this end, as shown in FIG. 5, force is exerted on the battery accommodating part 1*b* so as to bring both end parts of the battery accommodating part 1*b* close to each other which are positioned on an extended line of the first rib part 26*a* in its direction of extension (void arrows in the figure), and thereby, the opening 33 can be widely expanded. Notably, such both end parts are outer portions in the direction of extension of the first rib part 26*a* in the battery accommodating part 1*b*.

Specifically, compressive force is exerted on the battery accommodating part 1*b* in the direction crossing the direction in which the non-fixed part 32*b*, the accommodating projection 24 and the first rib part 26*a* line up, and both end parts of the battery accommodating part 1*b* in the crossing direction are bent in the same directions in the thickness direction. Thereby, in the cuttable region P, a gap is formed between the mount 10 and the non-fixed part 32*b* of the blister cover 20 over their entirety in the crossing direction. Thereby, the opening 33 can be expanded to the dimension with which the battery 2 can pass through. Notably, as mentioned above, when both end parts of the battery accommodating part 1*b* in the crossing direction are bent in the same directions in the thickness direction (to the mount 10 side), the battery accommodating part 1*b* is folded along the second rib parts 26*b*.

The reason is that when the aforementioned force is exerted on the battery accommodating part 1*b*, while the first rib part 26*a* pushes out in the direction of extension (the crossing direction), the mount 10 lower in rigidity in the crossing direction than the blister cover 20 bends so as to separate from the blister cover 20 in the thickness direction by both end parts in the crossing direction coming close to each other (see the hatched arrow in the figure), and thereby, the opening 33 between the mount 10 and the blister cover 20 widely expands.

Namely, the mount 10 is configured to bend in the thickness direction and to separate from the blister cover 20 in its region corresponding to the accommodating projection 24 in the crossing direction on the cut end face X formed by cutting at the cuttable region P as seen in the direction in which the non-fixed part 32*b*, the accommodating projection 24 and the first rib part 26*a* line up, when both end parts of the mount 10 and the blister cover 20 in the crossing direction are bent in the same directions in the thickness direction (to the mount 10 side) by exerting compressive force on the mount 10 and the blister cover 20 cut at the cuttable region P in the direction crossing the direction in which the non-fixed part 32*b*, the accommodating projection 24 and the first rib part 26*a* line up.

In the present embodiment, the mount 10 has a smaller thickness than the thickness of the blister cover 20 such that the aforementioned deformation can be realized. The mount 10 is preferably, for example, ¾ times or less as thick as the blister cover 20, still preferably ½ or less, further preferably ⅓ or less, most preferably ¼ or less.

Notably, the second rib parts 26*b* contribute to improvement in rigidity of portions other than the first rib part 26*a* in the battery accommodating part 1*b*. Therefore, providing the second rib parts 26*b* enables the opening 33 to be more widely expanded.

By widely expanding the opening 33 as above, the battery 2 can be easily taken out through the opening 33.

Moreover, the rigidity of the first rib part 26*a* is higher than the portion, out of the fixed portion of the mount 10 and the blister cover 20, positioned in the direction of extension (the crossing direction) relative to the first rib part 26*a*.

Thereby, by folding both end parts in the battery accommodating part 1*b* to the mount 10 side in the thickness direction to press the same such that both end parts above in the direction crossing the direction in which the non-fixed part 32*b*, the accommodating projection 24 and the first rib part 26*a* line up come close to each other, the mount 10 can be easily deformed on the cut end faces X relative to the blister cover 20. Therefore, by folding both end parts, in the battery accommodating part 1*b*, which are in the crossing direction to the mount 10 side in the thickness direction to press the same such that both end parts above come close to each other, the mount 10 and the blister cover 20 can be more easily separated from each other on the cut end faces X to more easily expand the opening on the cut end face X.

By cutting the cuttable region P of the battery packaging body 1 with scissors or the like as above, the opening 33 appears on the non-fixed part 32*b*. Thereby, while the battery 2 cannot be taken out from the battery packaging body 1 when the cuttable region P is not cut, the battery 2 can be taken out from the battery packaging body 1 by cutting the cuttable region P.

Accordingly, with the aforementioned configuration, there can be obtained the battery packaging body 1 which allows, while infants cannot easily take out the battery 2, the battery 2 to be easily taken out when a person other than infants is to use the battery 2.

In addition to this, with the battery packaging body 1 of the present embodiment, by cutting the blister cover 20 and the mount 10 with scissors or the like without peeling them off from each other, the battery 2 can be taken out. Therefore, since the configuration of the battery accommodating part 1*b* is maintained even after the battery 2 is taken out from the battery packaging body 1, a battery after replacement or the like can be accommodated again in the accommodating space S. Thereby, when such a used battery is stored until disposition thereof, is transported until being disposed into a recycling box, or undergoes the similar action, folding the opening portion can maintain the state where the used battery is accommodated in the accommodating space S of the battery accommodating part 1*b*, that is, the state where the used battery is covered by the mount 10 and the blister cover 20, without using a fixing member or the like. Therefore, short circuit of the battery can be prevented.

Embodiment 2

Figure 6:
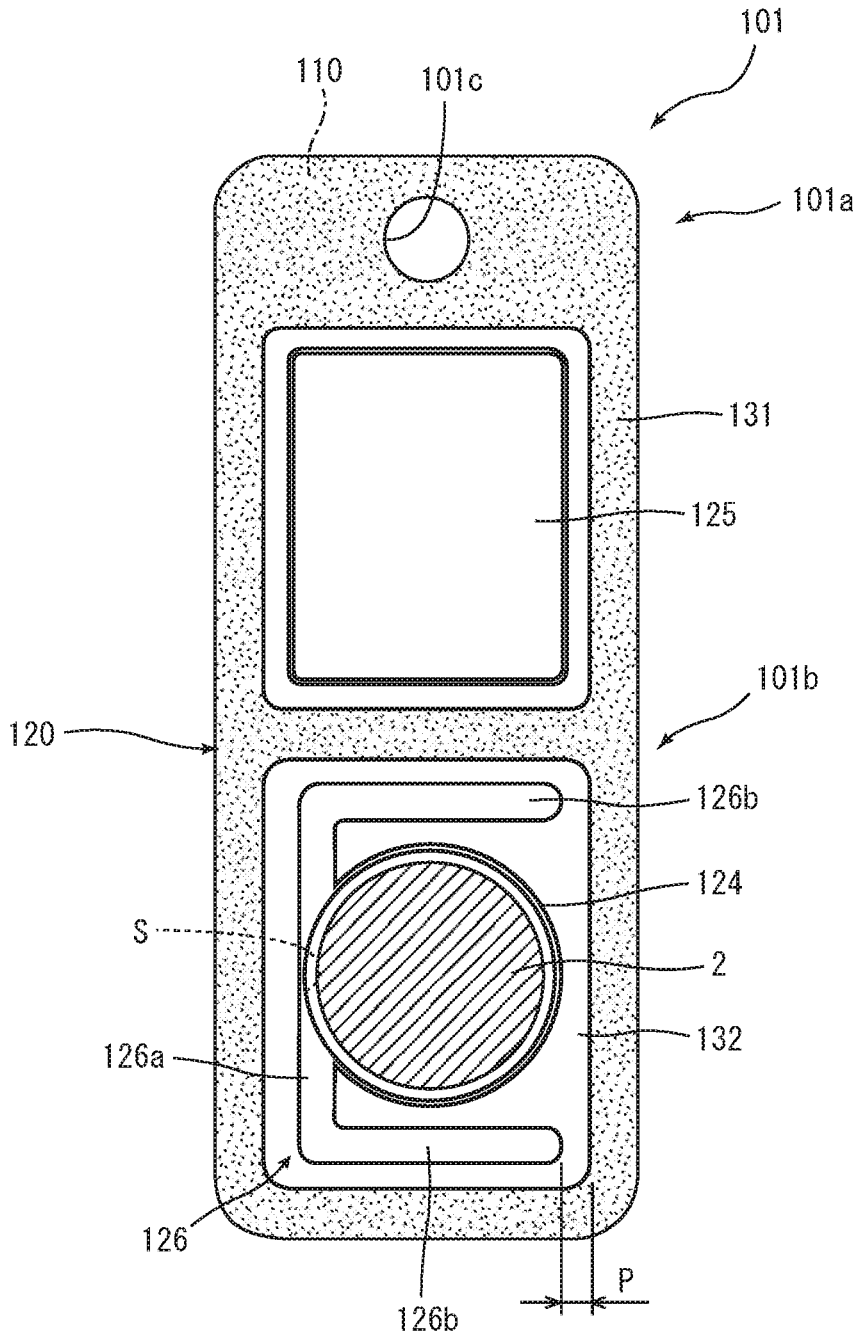
FIG. 6 is a view, corresponding to FIG. 1, showing a schematic configuration of a battery packaging body according to Embodiment 2.

FIG. 6 shows a schematic configuration of a battery packaging body 101 according to Embodiment 2 of the present invention. In the battery packaging body 101 of this embodiment, a configuration of a rib part 126 provided on a blister cover 120 is different from that in Embodiment 1. Hereafter, the configurations similar to those in Embodiment 1 are given the same signs as those in Embodiment 1, their description omitted, and only configurations different from those in Embodiment 1 are described.

As shown in FIG. 6, similarly to the battery packaging body 1 of Embodiment 1, the battery packaging body 101 has a mount 110 and the blister cover 120. The mount 110 and the blister cover 120 are fixed to each other except at an accommodating projection 124, a projection 125 and the rib part 126 which are mentioned later with an adhesive agent or the like. Notably, the mount 110 and the blister cover 120 are respectively composed of the similar materials to those of the mount 10 and the blister cover 20 of Embodiment 1.

The battery packaging body 101 has a held part 101*a* and a battery accommodating part 101*b*. The held part 101*a* is positioned on one side of the battery packaging body 101 in the longitudinal direction. The battery accommodating part 101*b* is positioned on the other side of the battery packaging body 101 in the longitudinal direction. Namely, the held part 101*a* and the battery accommodating part 101*b* are arranged to line up in one direction. Therefore, the battery packaging body 101 has a rectangular shape long in the one direction. The battery packaging body 101 according to the present embodiment is shorter in length in the transverse direction than the battery packaging body 1 of Embodiment 1.

The configuration of the held part 101*a* is the similar configuration to that of the held part 1*a* of Embodiment 1, its detailed description omitted. Notably, in FIG. 6, sign 101*c* designates a through hole, and sign 125 designates a projection.

The battery accommodating part 101*b* has the accommodating projection 124 and the rib part 126 formed on the blister cover 120. The accommodating projection 124 forms the accommodating space S having the dimension with which the battery 2 can be accommodated between the same and the mount 110. The rib part 126 has a first rib part 126*a* linearly extending in the longitudinal direction of the blister cover 120, and a pair of second rib parts 126*b* linearly extending in the transverse direction of the blister cover 120.

The first rib part 126*a* is positioned on one side relative to the accommodating projection 124 in the transverse direction of the blister cover 120. The first rib part 126*a* has a length greater than the diameter (dimension) of the battery 2 in the longitudinal direction of the blister cover 120. The center portion of the first rib part 126*a* in the direction of extension thereof is connected to the accommodating projection 124. Namely, parts of the first rib part 126*a* and the accommodating projection 124 are integrated. Thereby, the battery packaging body 101 can be made compact in the transverse direction of the battery packaging body 101.

The rigidity of the first rib part 126*a* is higher than the rigidity of portions positioned in the direction of extension (the crossing direction) relative to the first rib part 126*a* out of the fixed portion of the mount 10 and the blister cover 120.

The pair of second rib parts 126*b* are positioned on both sides in the longitudinal direction of the blister cover 120 relative to the accommodating projection 124. Each second rib part 126*b* has a length greater than the diameter (dimension) of the battery 2 in the transverse direction of the blister cover 120.

The first rib part 126*a* and the pair of second rib parts 126*b* are integrated. Namely, one side of each of the pair of second rib parts 126*b* in the transverse direction of the blister cover 120 is connected to corresponding one of both end parts of the first rib part 126*a* in the longitudinal direction of the blister cover 120. Thereby, the rib part 126 is formed into a substantial U-shape so as to enclose the accommodating projection 124.

Notably, the first rib part 126*a* and the second rib parts 126*b* have the similar configurations to those of the first rib part 26*a* and the second rib parts 26*b* of the Embodiment 1 except that the arrangement is different from that of those.

By providing the aforementioned rib part 126, the rigidity of around the accommodating projection 124 can be improved.

In addition to this, by providing the aforementioned first rib part 126*a*, the opening 133 formed on a cut end face, mentioned later, by cutting the cuttable region P can be widely expanded when the battery 2 is taken out from the battery packaging body 101 as mentioned later. Therefore, the battery 2 can be easily taken out from the accommodating space S.

The mount 110 and the blister cover 120 are fixed to each other at a portion other than the accommodating projection 124, the projection 125 and the rib part 126 with an adhesive agent (for example, mixed resin of polyester resin and epoxy resin, acrylic resin, copolymer resin of vinyl chloride and vinyl acetate, or the like), by heat sealing, or the like. Namely, the mount 110 and the blister cover 120 are fixed to each other at least at their peripheral edge parts. Moreover, the mount 110 and the blister cover 120 are fixed to each other also between the projection 125 and the accommodating projection 124 and the rib part 126. FIG. 6 shows a fixed part 131 in which the mount 110 and the blister cover 120 are fixed to each other as the dotted area.

As above, the mount 110 and the blister cover 120 are fixed to each other at their peripheral edge parts, and thereby, infants can be prevented from easily opening the battery packaging body 101.

The battery packaging body 101 has a non-fixed part 132 at which the mount 110 and the blister cover 120 are not fixed to each other on the other side thereof in the transverse direction, that is, on the opposite side to the first rib part 126*a* across the accommodating projection 124. The non-fixed part 132 is continuous to the accommodating projection 124 and the rib part 126. Namely, a fixed part does not exist between the non-fixed part 132 and the accommodating projection 124 and the rib part 126.

The non-fixed part 132 is provided to linearly extend in the longitudinal direction of the battery packaging body 101 on the opposite side to the first rib part 126*a* across of the accommodating projection 124 in the transverse direction of the battery packaging body 101. The non-fixed part 132 constitutes a part of the cuttable region P which is cut with scissors or the like when the battery packaging body 101 is opened as mentioned later. Namely, the battery packaging body 101 is to be cut in the longitudinal direction so as also to cut the non-fixed part 132, and thereby, the opening 133 is formed in the non-fixed part 132. Hence, the battery 2 in the accommodating space S can be taken out through the opening 133.

Notably, in the present embodiment, the battery packaging body 101 has non-fixed parts also around the projection 125 and the rib part 126 (see white areas in FIG. 6). Nevertheless, the battery packaging body 101 does not need to have such non-fixed parts other than the aforementioned non-fixed part 132.

In the cuttable region P, at least a center portion of the blister cover 120 in the longitudinal direction as seen in the thickness direction is flat plate-shaped to be parallel to the mount 110 in the thickness direction. Namely, in at least the center portion of the cuttable region P in the longitudinal direction, convexities and concavities are not formed on the blister cover 120. In the present embodiment, in the cuttable region P, the blister cover 120 is flat plate-shaped to be parallel to the mount 110 in the thickness direction. Moreover, in the non-fixed part 132, the cuttable region P is positioned in the direction in which the non-fixed part, the accommodating projection and the first rib part line up relative to the second rib parts 126*b*. Namely, in the non-fixed part 132, the cuttable region P does not overlap with the second rib parts 126*b* of the blister cover 120 as seen in the thickness direction of the blister cover 120. Thereby, the battery packaging body 101 can be easily cut at the cuttable region P.

Notably, to be parallel means that the blister cover 120 is disposed along the mount 110 and the distance between the mount 110 and the blister cover 120 is uniform.

(Taking-Out of Battery from Battery Packaging Body)

Next, opening the battery packaging body 101 having the aforementioned configuration is described.

Figure 7:
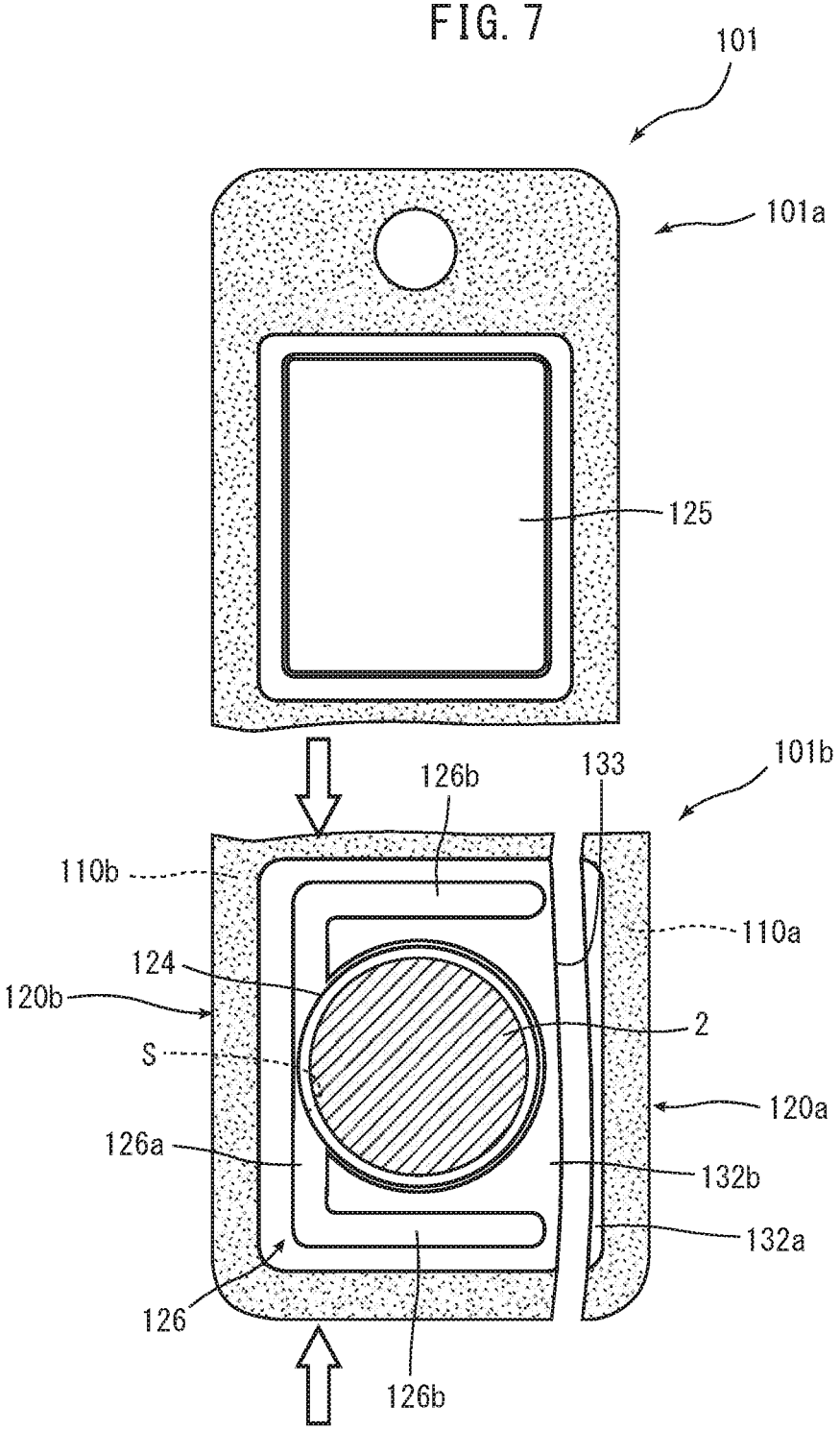
FIG. 7 is a view showing a state where the battery packaging body is cut at the cuttable region.

As shown in FIG. 7, when the battery packaging body 101 is cut between the projection 125 and the rib part 126 with scissors or the like, the battery packaging body 101 is separated into the held part 101*a* and the battery accommodating part 101*b*. Thereby, the held part 101*a* which is not needed when the battery packaging body 101 is opened can be removed.

After that, the cuttable region P of the battery accommodating part 101*b* is cut with scissors or the like. In the following description, pieces of the blister cover after cut at the cuttable region P are individually referred to as blister covers 120*a* and 120*b*, and pieces of the mount after cut at the cuttable region P are individually referred to as mounts 110*a* and 110*b*. Moreover, pieces of the non-fixed part after cut at the cuttable region P are individually referred to as non-fixed parts 132*a* and 132*b*.

By cutting the cuttable region P of the battery accommodating part 101*b* with scissors or the like as above, the non-fixed part 132 is segmented into the non-fixed parts 132*a* and 132*b*. Thereby, the opening 133 is formed on the cut end face of the non-fixed part 132*b*. The non-fixed part 132*b* is continuous to the accommodating projection 124. Therefore, formation of the opening 133 in the non-fixed part 132*b* allows the accommodating space S formed of the accommodating projection 124 to be continuous to the outside through the opening 133. Nevertheless, since the non-fixed part 132*b* is formed to be a flat plane shape along the mount 110*b*, the opening area of the opening 133 is small. Therefore, in order to take out the battery 2 to the outside, the opening area of the opening 133 needs to be expanded to the dimension with which the battery can pass through.

To this end, force is exerted on the battery accommodating part 101*b* after cutting so as to bring both end parts of the battery accommodating part 101*b* close to each other which are positioned on an extended line of the first rib part 126*a* in its direction of extension, and thereby, the opening 133 can be widely expanded. Notably, such both end parts are outer portions in the direction of extension of the first rib part 26*a* in the battery accommodating part 1*b*.

Specifically, compressive force is exerted on the battery accommodating part 101*b* in the direction crossing the direction in which the non-fixed part 132*b*, the accommodating projection 124 and the first rib part 126*a* line up, and both end parts of the battery accommodating part 101*b* in the crossing direction are bent in the same directions in the thickness direction. Thereby, in the cuttable region P, a gap is formed between the mount 110 and the non-fixed part 132*b* of the blister cover 120 over their entirety in the crossing direction. Thereby, the opening 133 can be expanded to the dimension with which the battery 2 can pass through. Notably, as mentioned above, when both end parts of the battery accommodating part 101*b* in the crossing direction are bent in the same directions in the thickness direction (to the mount 110 side), the battery accommodating part 101*b* is folded along the second rib parts 126*b*.

The reason is that when the aforementioned force is exerted on the battery accommodating part 101*b* after cutting, while the first rib part 126*a* pushes out in the direction of extension (the crossing direction), the mount 110 lower in rigidity in the crossing direction than the blister cover 120 bends so as to separate from the blister cover 120 in the thickness direction by both end parts in the crossing direction coming close to each other, and thereby, the opening 133 between the mount 110 and the blister cover 120 widely expands.

Namely, the mount 110 is configured to bend in the thickness direction and to separate from the blister cover 120 in its region corresponding to the accommodating projection 124 in the crossing direction on the cut end face formed by cutting at the cuttable region P as seen in the direction in which the non-fixed part 132*b*, the accommodating projection 124 and the first rib part 126*a* line up, when both end parts of the mount 110 and the blister cover 120 in the crossing direction are bent in the same directions in the thickness direction (to the mount 110 side) by exerting compressive force on the mount 110 and the blister cover 120 cut at the cuttable region P in the direction crossing the direction in which the non-fixed part 132*b*, the accommodating projection 124 and the first rib part 126*a* line up.

Notably, the second rib parts 126*b* contribute to improvement in rigidity of portions other than the first rib part 126*a* in the battery accommodating part 101*b* after cutting. Therefore, providing the second rib parts 126*b* enables the opening 133 to be more widely expanded.

By widely expand the opening 133 as above, the battery 2 can be easily taken out through the opening 133.

Moreover, the rigidity of the first rib part 126*a* is higher than the portion, out of the fixed portion of the mount 110 and the blister cover 120, positioned in the direction of extension (the crossing direction) relative to the first rib part 126*a*.

Thereby, by folding both end parts in the battery accommodating part 101*b* to the mount 110 side in the thickness direction to press the same such that both end parts above in the direction crossing the direction in which the non-fixed part 132*b*, the accommodating projection 124 and the first rib part 126*a* line up come close to each other, the mount 110 can be easily deformed on the cut end face relative to the blister cover 120. Therefore, by folding both end parts, in the battery accommodating part 101*b*, which are in the crossing direction to the mount 110 side in the thickness direction to press the same such that both end parts above come close to each other, the mount 110 and the blister cover 120 can be more easily separated from each other on the cut end face to more easily expand the opening on the cut end face.

Accordingly, also with the configuration of the present embodiment, there can be obtained the battery packaging body 101 which allows, while infants cannot easily take out the battery 2, the battery 2 to be easily taken out when a person other than infants is to use the battery 2.

In addition to this, with the battery packaging body 101 of the present embodiment, by cutting the blister cover 120 and the mount 110 with scissors or the like without peeling them off from each other, the battery 2 can be taken out. Therefore, since the configuration of the battery accommodating part 101*b* is maintained even after the battery 2 is taken out from the battery packaging body 1, a battery after replacement or the like can be accommodated again in the accommodating space S. Thereby, when such a used battery is stored until disposition thereof, is transported until being disposed into a recycling box, or undergoes the similar action, folding the opening portion can maintain the state where the used battery is accommodated in the accommodating space S of the battery accommodating part 101*b*, that is, the state where the used battery is covered by the mount 110 and the blister cover 120, without using a fixing member or the like. Therefore, short circuit of the battery can be prevented.

Embodiment 3

Figure 8:
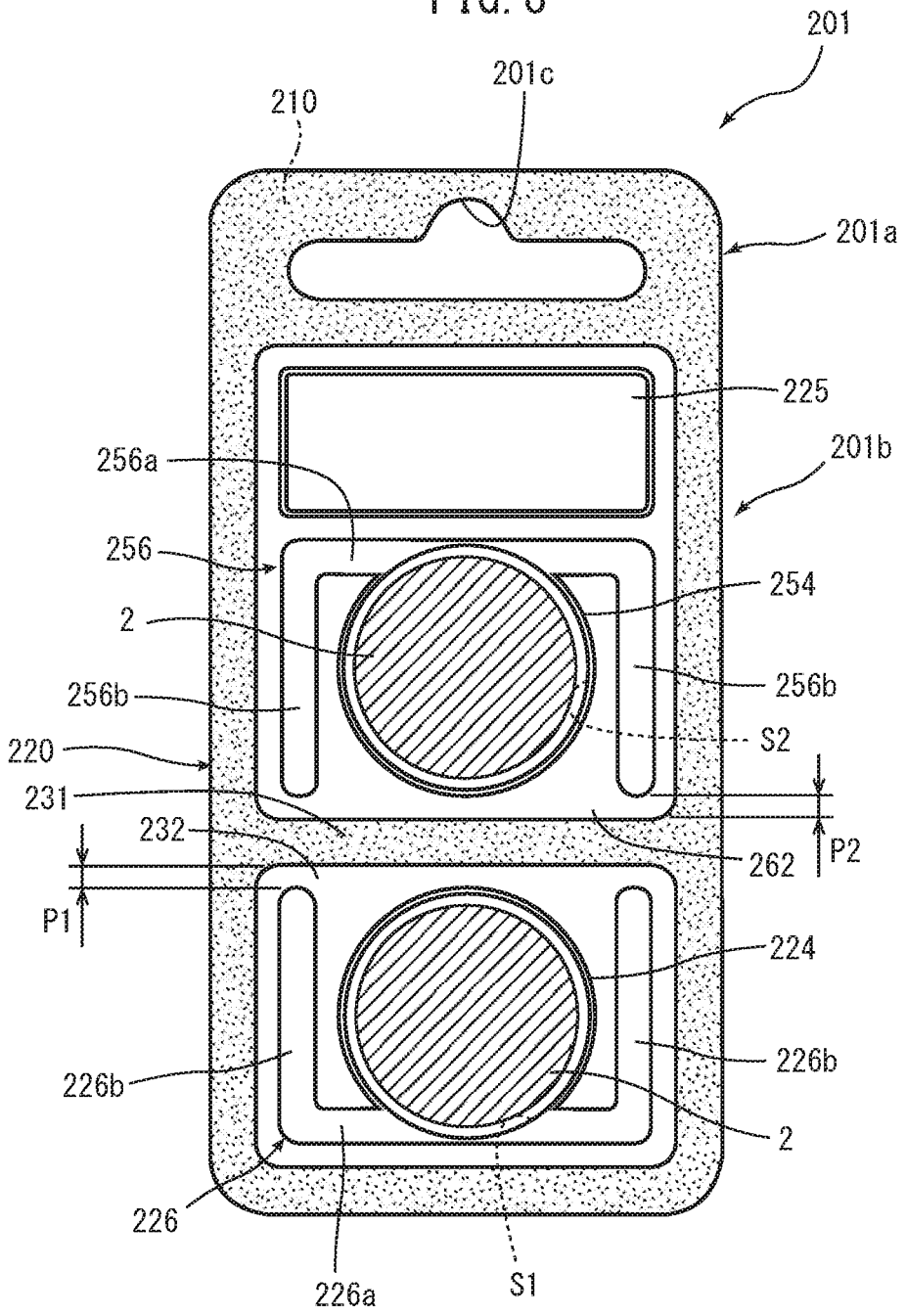
FIG. 8 is a view, corresponding to FIG. 1, showing a schematic configuration of a battery packaging body according to Embodiment 3.

FIG. 8 shows a schematic configuration of a battery packaging body 201 according to Embodiment 3 of the present invention. The battery packaging body 201 of this embodiment has a different configuration from that of Embodiment 1 in that two accommodating projections 224 and 254 and two rib parts 226 and 256 are provided in the battery accommodating part 201*b*. Hereafter, the configurations similar to those in Embodiment 1 are given the same signs as those in Embodiment 1, their description omitted, and only configurations different from those in Embodiment 1 are described.

As shown in FIG. 8, similarly to the battery packaging body 1 of Embodiment 1, the battery packaging body 201 has a mount 210 and a blister cover 220. The mount 210 and the blister cover 220 are fixed to each other except at the accommodating projections 224 and 254, a projection 225 and the rib parts 226 and 256 which are mentioned later with an adhesive agent or the like. Notably, the mount 210 and the blister cover 220 are respectively composed of the similar materials to those of the mount 10 and the blister cover 20 of Embodiment 1.

The battery packaging body 201 has a held part 201*a* and a battery accommodating part 201*b*. The held part 201*a* is positioned on one side of the battery packaging body 201 in the longitudinal direction. The battery accommodating part 201*b* is positioned on the other side of the battery packaging body 201 in the longitudinal direction. Namely, the held part 201*a* and the battery accommodating part 201*b* are arranged to line up in one direction. Therefore, the battery packaging body 201 has a rectangular shape long in the one direction.

The configuration of the held part 201*a* is the similar configuration to that of the held part 1*a* of Embodiment 1, its detailed description omitted. Notably, in FIG. 8, sign 201*c* designates a through hole, and sign 225 designates a projection.

The battery accommodating part 201*b* has the accommodating projections 224 and 254 and the rib parts 226 and 256 formed on the blister cover 220. The accommodating projections 224 and 254 respectively form accommodating spaces S1 and S2 each having the dimensions with which the battery 2 can be accommodated between the same and the mount 210. The accommodating projections 224 and 254 are provided to line up in the longitudinal direction of the blister cover 220.

The rib part 226 is formed to be substantially U-shaped so as to enclose the accommodating projection 224. The rib part 256 is formed to be substantially U-shaped so as to enclose the accommodating projection 254. Each of the rib part 226, 256 has a first rib part 226*a*, 256*a* extending in the transverse direction of the blister cover 220, and a pair of second rib parts 226*b*, 256*b* extending in the longitudinal direction of the blister cover 220.

The accommodating projections 224 and 254 and the rib parts 226 and 256 have the similar configurations to those of the accommodating projection 24 and the rib part 26 of Embodiment 1, their detailed description omitted.

In the present embodiment, the rib parts 226 and 256 are provided such that the first rib parts 226*a* and 256*a* are positioned on the opposite sides across the accommodating projections 224 and 254 in the longitudinal direction of the blister cover 220.

Moreover, in the present embodiment, non-fixed parts 232 and 262 are provided between the accommodating projections 224 and 254 in the longitudinal direction of the blister cover 220. A fixed part 231 is provided between the non-fixed parts 232 and 262. The configurations of the non-fixed parts 232 and 262 are similar to the configuration of the non-fixed part 32 in Embodiment 1, their detailed description omitted.

Notably, in the present embodiment, the rib parts 226 and 256, the accommodating projections 224 and 254, and the non-fixed parts 232 and 262 are symmetrically arranged in the longitudinal direction of the battery packaging body 201 across the fixed part 231 positioned between the non-fixed parts 232 and 262. Nevertheless, the arrangements, orientations and the like of the rib parts 226 and 256, the accommodating projections 224 and 254, and the non-fixed parts 232 and 262 are not limited to the configurations in the present embodiment as long as the positional relation between the rib part 226, the accommodating projection 224 and the non-fixed part 232 is equivalent to the positional relation between those in the present embodiment, and the positional relation between the rib part 256, the accommodating projection 254 and the non-fixed part 262 is equivalent to the positional relation between those in the present embodiment.

When the batteries 2 are taken out from the battery packaging body 201, cuttable regions P1 and P2 constituted of parts of the non-fixed parts 232 and 262 are individually cut with scissors or the like. Namely, when the battery 2 in the accommodating space S1 is taken out, the cuttable region P1 is cut which is constituted of a part of the non-fixed part 232. Meanwhile, when the battery 2 in the accommodating space S2 is taken out, the cuttable region P2 is cut which is constituted of a part of the non-fixed part 262. A method of taking out each battery 2 is similar to that in Embodiment 1.

Accordingly, also with the configuration of the present embodiment, there can be obtained the battery packaging body 201 which allows, while infants cannot easily take out the battery 2, the battery 2 to be easily taken out when a person other than infants is to use the battery 2.

Other Embodiments

As above, embodiments of the present invention have been described. The aforementioned embodiments are merely exemplary for implementing the present invention. Hence, the present invention is not limited to the aforementioned embodiments but can be implemented by properly modifying or altering the aforementioned embodiments without departing from its scope and spirit.

In each embodiment above, the rib part 26, 126, 226, 256 has the second rib parts 26*b*, 126*b*, 226*b*, 256*b*. Nevertheless, the rib part does not need to have a second rib part. Namely, the rib part may have only the first rib part.

Figure 9:
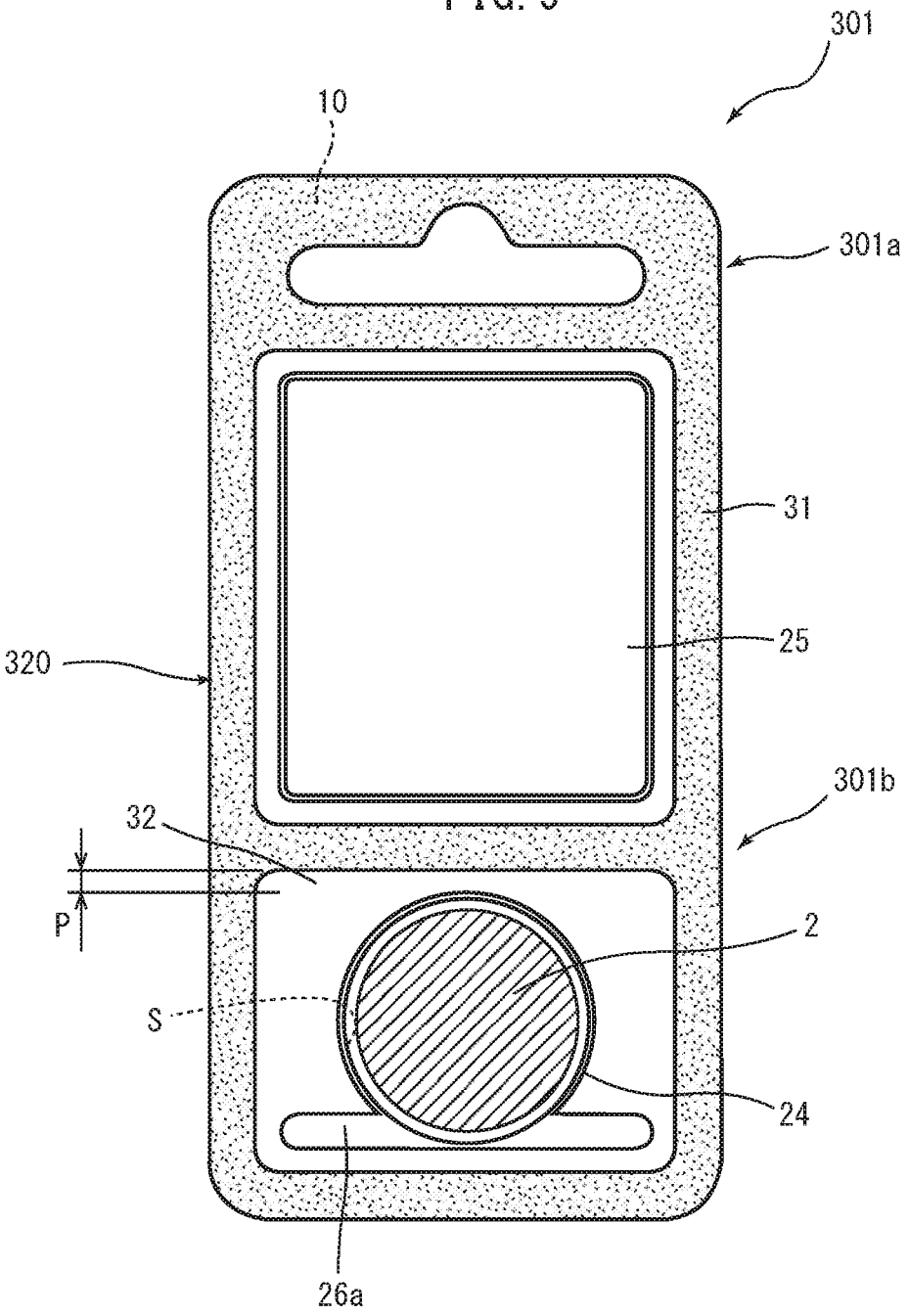
FIG. 9 is a view, corresponding to FIG. 1, showing a schematic configuration of a battery packaging body according to another embodiment.

Specifically, for example, as shown in FIG. 9, while a blister cover 320 has the first rib part 26*a* extending in the transverse direction of a battery packaging body 301, it does not have the second rib part as in each embodiment above. Also in this case, the battery packaging body 301 has the non-fixed part 32 on the opposite side to the first rib part 26*a* across the accommodating projection 24 in the longitudinal direction. Thereby, by cutting the cuttable region P constituted of a part of the non-fixed part 32 with scissors or the like, the battery 2 in the accommodating space S can be taken out. In FIG. 9, sign 301*a* designates a held part, and sign 301*b* designates a battery accommodating part.

Notably, the blister cover may have a rib except the first rib part and the second rib part.

In each embodiment above, the first rib part 26*a*, 126*a*, 226*a*, 256*a* and the second rib parts 26*b*, 126*b*, 226*b*, 256*b* are perpendicular to each other. Nevertheless, the first rib part and the second rib parts do not need to be perpendicular to each other as long as they extend in directions crossing each other.

In each embodiment above, each of the first rib part 26*a*, 126*a*, 226*a*, 256*a* and the second rib parts 26*b*, 126*b*, 226*b*, 256*b* of the rib part 26, 126, 226, 256 is linear. Nevertheless, one or both of the first rib part and the second rib parts may be curved.

In each embodiment above, the battery packaging body 1, 101, 201, 301 is rectangular in plan view. Nevertheless, the battery packaging body may have a shape other than a rectangle.

In each embodiment above, the rib part 26, 126, 226, 256 is smaller in height of protrusion than the accommodating projection 24, 124, 224, 254.

Nevertheless, the rib part may be greater in height of protrusion than the accommodating projection.

In each embodiment above, in the blister cover 20, 120, 220, 320, the accommodating projection 24, 124, 224, 254, the rib part 26, 126, 226, 256, the projection 25, 125, 225, and the non-fixed part 32, 132, 232, 262 are provided. Nevertheless, in the mount, an accommodating projection, a rib part, a projection, and a non-fixed part may be provided. Otherwise, in both of the blister cover and the mount, accommodating projections, rib parts, projections, and non-fixed parts may be provided.

In each embodiment above, the mount 10, 110, 210 and the blister cover 20, 120, 220, 320 are bonded and fixed to each other. Nevertheless, a method for fixing the mount and the blister cover may be welding fixation, or fixation with a fixing member or the like, as well as the bonding fixation described for each embodiment above.

In each embodiment above, the mount 10, 110, 210 and the blister cover 20, 120, 220, 320 are bonded and fixed to each other at their flat planes except at the through hole 1*c*, 101*c*, 201*c*, the accommodating projection 24, 124, 224, 254, the rib part 26, 126, 226, 256, and the projection 25, 125, 225. Nevertheless, portions of the mount and the blister cover except at the through hole, the accommodating projection, the rib part, and the projection do not need to be flat. Moreover, the portions except at those do not need to be entirely bonded and fixed to each other. It should be noted that the mount and the blister cover need to be bonded and fixed to each other at their peripheral edge parts.

In Embodiment 1, the mount 10 has a smaller thickness than the thickness of the blister cover 20. Nevertheless, the mount may have a thickness not less than the thickness of the blister cover.

In each embodiment above, the battery 2 packaged by the battery packaging body 1, 101, 201, 301 is a button-type battery or a coin-type battery. Nevertheless, when another small battery is to be packaged, the configuration of the embodiment may be applied to the battery packaging body.

INDUSTRIAL APPLICABILITY

A battery packaging body according to the present invention can be used for cases of packaging a small battery such as a button-type battery or a coin-type battery.

REFERENCE SIGNS LIST

1, 101, 201, 301 Battery packaging body
1*a*, 101*a*, 201*a*, 301*a* Held part
1*b*, 101*b*, 201*b*, 301*b* Battery accommodating part
1*c*, 101*c*, 201*c* Through hole
2 Battery
10, 110, 210 Mount (first member)
10*a*, 110*a* Mount after cutting
10*b*, 110*b* Mount after cutting
20, 120, 220, 320 Blister cover (second member)
20*a*, 120*a* Blister cover after cutting
20*b*, 120*b* Blister cover after cutting
24, 124, 224, 254 Accommodating projection
25, 125, 225 Projection
26, 126, 226, 256 Rib part
26*a*, 126*a*, 226*a*, 256*a* First rib part
26*b*, 126*b*, 226*b*, 256*b* Second rib part
32, 132, 232, 262 Non-fixed part
32*a*, 132*a* Non-fixed part after cutting
32*b*, 132*b* Non-fixed part after cutting
33, 133 Opening
S, S1, S2 Accommodating space
P, P1, P2 Cuttable region
X Cut end face

The invention claimed is:

1. A battery packaging body for packaging a battery, comprising:
- a first member; and
- a second member capable of accommodating the battery between the same and the first member, wherein
- the first member and the second member are fixed to each other at least at their peripheral edge parts,
- the second member has
  - an accommodating projection protruding in a thickness direction of the second member so as to form an accommodating space capable of accommodating the battery between the same and the first member,
  - a non-fixed part provided at a position continuous to the accommodating projection and not fixed to the first member, and
  - a first rib part connected to the accommodating projection and protruding in the thickness direction of the second member,
- the non-fixed part is positioned on an opposite side to the first rib part across the accommodating projection and constitutes a part of a cuttable region cut when the battery packaging body is opened, and
- the first rib part extends in a direction crossing a direction in which the non-fixed part, the accommodating projection and the first rib part line up.

2. The battery packaging body according to claim 1, wherein the cuttable region linearly extends in the crossing direction.

3. The battery packaging body according to claim 1, the first rib part has a length greater than a dimension of the accommodating portion in the crossing direction.

4. The battery packaging body according to claim 1, the second member has a pair of second rib parts connected to the first rib part; the pair of second rib parts extending in the direction in which the non-fixed part, the accommodating projection and the first rib part line up.

5. The battery packaging body according to claim 4, wherein the first rib part has two ends parts, and each of the pair of second rib parts is connected to a corresponding one of the two end parts of the first rib part, and the first rib part and the second rib part constitute a rib part integratedly formed to be U-shaped as a whole as seen in the thickness direction of the second member.

6. The battery packaging body according to claim 4, wherein in the cuttable region, at least a center portion of the second member in the crossing direction as seen in the thickness direction of the second member is flat plate-shaped to be parallel to the first member in the thickness direction.

7. The battery packaging body according to claim 4, wherein
- in the cuttable region, the second member is flat plate-shaped to be parallel to the first member in the thickness direction, and
- in the non-fixed part, the cuttable region does not overlap with the second rib part as seen in the thickness direction of the second member.

8. The battery packaging body according to claim 1, wherein the first rib part is connected to the accommodating projection.

9. The battery packaging body according to claim 1, wherein the rigidity of the first member is lower than the rigidity of the second member in the direction crossing the direction in which the non-fixed part, the accommodating projection and the first rib part line up.

10. The battery packaging body according to claim 1, wherein the rigidity of the first rib part is higher than the rigidity of a portion positioned in the crossing direction relative to the first rib part out of a portion in which the first member and the second member are fixed to each other.

11. The battery packaging body according to claim 1, wherein a thickness of the first member is smaller than a thickness of the second member.

12. The battery packaging body according to claim 5, wherein two accommodating projections are provided.

13. The battery packaging body according to claim 12, wherein the two rib parts are positioned on the opposite sides across the two accommodating projections in the longitudinal direction of the second member.

* * * * *